US010414547B2

(12) United States Patent
Rosenburg et al.

(10) Patent No.: US 10,414,547 B2
(45) Date of Patent: Sep. 17, 2019

(54) FLAP TIE BAG

(71) Applicant: API Industries, Inc., Orangeburg, NY (US)

(72) Inventors: Susan Rosenburg, Lawrence, NY (US); David Anderson, Orangeburg, NY (US)

(73) Assignee: API Industries, Inc., Orangeburg, NY (US)

( * ) Notice: Subject to any disclaimer, the term of this patent is extended or adjusted under 35 U.S.C. 154(b) by 0 days.

(21) Appl. No.: 14/560,894

(22) Filed: Dec. 4, 2014

(65) Prior Publication Data

US 2016/0159524 A1 Jun. 9, 2016

(51) Int. Cl.

| | |
|---|---|
| ***B65D 33/06*** | (2006.01) |
| ***B65D 33/16*** | (2006.01) |
| ***B65D 33/08*** | (2006.01) |
| ***B65D 33/10*** | (2006.01) |

(52) U.S. Cl.

CPC ..... *B65D 33/065* (2013.01); *B65D 33/08* (2013.01); *B65D 33/10* (2013.01); *B65D 33/1608* (2013.01)

(58) Field of Classification Search

CPC .. B65D 33/10; B65D 33/1608; B65D 33/065; B65D 33/08

USPC ..... 383/8, 10, 77

See application file for complete search history.

(56) References Cited

U.S. PATENT DOCUMENTS 4,867,575 A * 9/1989 Wood ..... B65D 33/06 383/17
4,890,736 A * 1/1990 Johannes ..... B65D 33/1608 206/390
5,246,110 A * 9/1993 Greyvenstein ..... B65D 33/1608 206/390
5,282,686 A * 2/1994 Haber ..... B65D 33/1608 383/10
5,576,037 A * 11/1996 Moore, Jr. ..... B65D 75/002 206/497
5,908,244 A * 6/1999 Galambos ..... B65D 33/165 383/77
8,083,409 B2 * 12/2011 Gelbard ..... B65D 33/002 383/10

(Continued)

FOREIGN PATENT DOCUMENTS

FR 2676989 A1 * 12/1992 ..... B65B 61/14
FR 2689099 A1 * 10/1993 ..... B65D 33/065

(Continued)

OTHER PUBLICATIONS

Macnine translation of the description of FR 2676989 A1.*
Machine translation of the description of FR 2689099 A1.*

*Primary Examiner* — Jes F Pascua

(57) ABSTRACT

A unitary trash bag includes a closed bag end and an open bag end located opposite the closed bag end. A plurality of flaps ae located at the open bag end. The flaps are arranged around a perimeter of the open bag end, each flap of the plurality of flaps including a flap opening in the flap to grasp and/or close the bag. A method of forming a trash bag includes forming a tubular film of material and sealing an edge of the tubular film, thereby defining a closed bag end. The film is cut at an open bag end opposite to the closed bag end to define a plurality of flaps in the film at the open bag end. A plurality of flap openings are cut in the film at the flaps and between the open bag end and the closed bag end.

8 Claims, 3 Drawing Sheets

(56) References Cited

U.S. PATENT DOCUMENTS

| | | | | |
|---|---|---|---|---|
| 8,550,712 | B2 * | 10/2013 | Ebner | B65D 31/08 383/10 |
| 8,668,387 | B2 * | 3/2014 | Ebner | B65D 5/18 383/10 |
| 8,790,009 | B2 * | 7/2014 | Saville | B31B 1/00 383/10 |
| 2007/0031067 | A1 * | 2/2007 | Gebhardt | B65D 33/243 383/7 |
| 2012/0145733 | A1 * | 6/2012 | Heilman | B65D 75/56 220/759 |
| 2014/0270578 | A1 * | 9/2014 | Ebner | B31B 41/00 383/10 |

FOREIGN PATENT DOCUMENTS

| | | | | |
|---|---|---|---|---|
| JP | 10338302 | A * | 12/1998 | B65D 33/1608 |
| JP | 2004345649 | A * | 12/2004 | |

* cited by examiner

FLAP TIE BAG

BACKGROUND

The subject matter disclosed herein relates to bags, typically formed from a plastic material and utilized for trash or other refuse.

A typical bag utilized for purposes such as trash or refuse disposal and/or material storage, is formed from a plastic or polymer material. Such bags have various features and configurations for closure and or handling of the bag. On type of such bag is a drawstring closure bag. A drawstring closure bag has a sleeve formed in the bag containing a drawstring, with access to the drawstring provided by openings n the sleeve. When desired, drawstring is pulled from the openings and utilized to lift or carry the bag, and/or may be knotted to close the bag opening.

Another type of such bag is referred to as a flap tie bag. Flap tie bags have their opening at least partially defined by a number or protrusions or flaps. To close the bag opening, flaps at opposing sides of the bag opening may be knotted together. Flap configurations, however, often make knotting of the flaps difficult, and often result in a closure of the bag that is not optimally secure. Further, a typical flap tie bag does not provide effective means for lifting and/or carrying the bag.

SUMMARY

In one embodiment a unitary trash bag includes a closed bag end and an open bag end located opposite the closed bag end. A plurality of flaps ae located at the open bag end. The flaps are arranged around a perimeter of the open bag end, each flap of the plurality of flaps including a flap opening in the flap to grasp and/or close the bag.

Additionally or alternatively, in this or other embodiments the plurality of flaps are configured such that a first flap of the plurality of flaps having a first flap opening is insertable into a second flap opening of a second flap of the plurality of flaps.

Additionally or alternatively, in this or other embodiments the first flap and the second flap are located opposite each other across the open bag end.

Additionally or alternatively, in this or other embodiments additional flaps of the plurality of flaps are configured to be insertable into the second flap opening.

Additionally or alternatively, in this or other embodiments the plurality of flaps is four flaps.

Additionally or alternatively, in this or other embodiments the flap opening is one of semi-circular, circular, elliptical, oval, rectangular or rounded-rectangular in shape.

Additionally or alternatively, in this or other embodiments a flap edge and a flap opening edge define a flap handle therebetween.

Additionally or alternatively, in this or other embodiments the flap opening edge is a constant distance from the flap edge, defining a flap handle having a constant width along its length.

Additionally or alternatively, in this or other embodiments the plurality of flaps are defined as localized increases in a distance from the closed bag end to the open bag end.

Additionally or alternatively, in this or other embodiments the bag is formed from a polyethylene material.

In another embodiment, a method of forming a trash bag includes forming a tubular film of material and sealing an edge of the tubular film, thereby defining a closed bag end. The film is cut at an open bag end opposite to the closed bag end to define a plurality of flaps in the film at the open bag end. A plurality of flap openings are cut in the film at the flaps and between the open bag end and the closed bag end.

Additionally or alternatively, in this or other embodiments the flap openings are cut in the film via die cutting.

Additionally or alternatively, in this or other embodiments the flap opening is one of semi-circular, circular, elliptical, oval, rectangular or rounded-rectangular in shape.

Additionally or alternatively, in this or other embodiments a flap edge and a flap opening edge define a flap handle therebetween.

Additionally or alternatively, in this or other embodiments the flap opening edge is a constant distance from the flap edge, defining a flap handle having a constant width along its length.

Additionally or alternatively, in this or other embodiments the plurality of flaps are defined as localized increases in a distance from the closed bag end to the open bag end.

Additionally or alternatively, in this or other embodiments the sealing an edge of the tubular film is accomplished by an application of heat to the tubular film.

In yet another embodiment, a unitary trash bag includes a closed bag end and an open bag end disposed opposite the closed bag end. A plurality of flaps are included at the open bag end and are arranged around a perimeter of the open bag end. Each flap of the plurality of flaps includes a flap opening in the flap to grasp and/or close the bag. The plurality of flaps are configured such that a first flap of the plurality of flaps has a first flap opening insertable into a second flap opening of a second flap of the plurality of flaps disposed opposite the first flap across the open bag end. The flap opening is one of semi-circular, circular, elliptical, oval, rectangular or rounded-rectangular in shape and defines a flap handle between a flap edge and a flap opening edge. The bag is formed from a tubular film of polyethylene material.

Additionally or alternatively, in this or other embodiments additional flaps of the plurality of flaps are configured to be insertable into the second flap opening.

Additionally or alternatively, in this or other embodiments the plurality of flaps is four flaps.

These and other advantages and features will become more apparent from the following description taken in conjunction with the drawings.

DRAWINGS

The subject matter, which is regarded as the invention, is particularly pointed out and distinctly claimed in the claims at the conclusion of the specification. The foregoing and other features, and advantages of the invention are apparent from the following detailed description taken in conjunction with the accompanying drawings in which:

Figure 1:
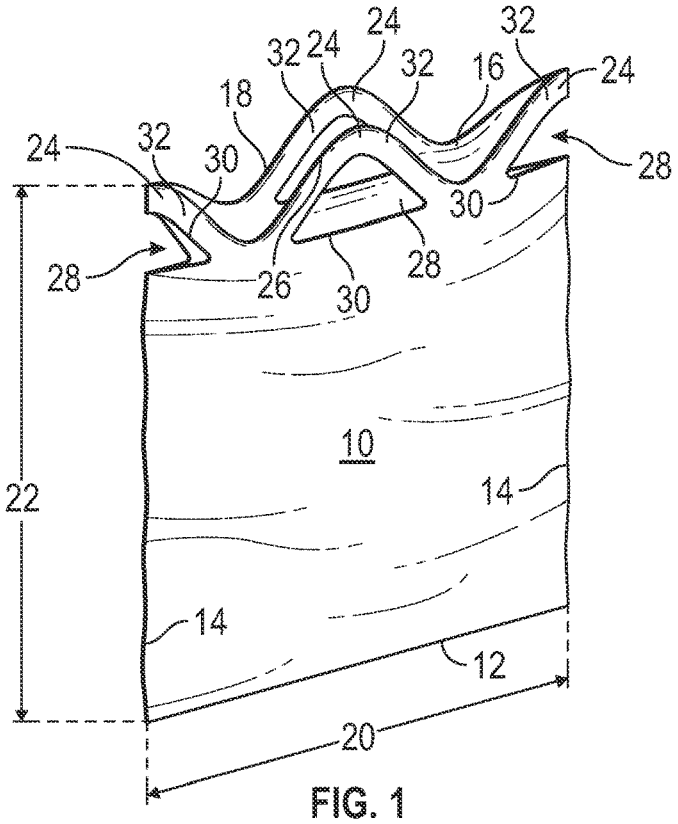
FIG. 1 is a perspective view of an embodiment of a flap-tie bag.

The detailed description explains embodiments of the invention, together with advantages and features, by way of example with reference to the drawing.

DETAILED DESCRIPTION

Figure 2:
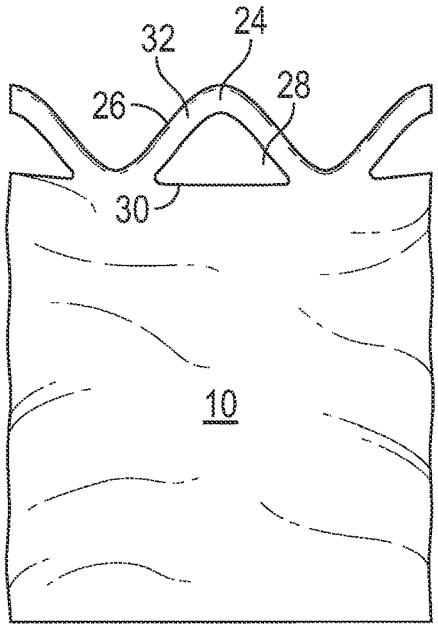
FIG. 2 is an illustration of an embodiment of a flap portion of a flap-tie bag.

Shown in FIGS. 1 and 2 is an embodiment of a bag 10, also referred to as a "trash bag", utilized for trash or refuse disposal and/or material storage. The bag 10 is formed from a polyolefin material, more specifically, in some embodiments, polyethylene. The bag 10 has a bottom edge 12, two side edges 14, and a bag opening 16 located opposite the bottom edge 12, and defined by an opening edge 18. The bag 10 has a bag width 20 defined as a distance between opposing side edges 14. Further the bag 10 has a bag height 22 defined as a distance between the bottom edge 12 and the opening edge 18. The bag 10 is a flap tie bag 10, having a plurality of flaps 24 disposed at the bag opening 16. In some embodiments, the flaps 24 are defined by a localized increase in bag height 22. In some embodiments, the flaps 24 have, for example, a curvilinear flap edge 26 located at the bag opening 16. While a quantity of flaps 24 arranged around the bag opening 16 may vary depending on requirements and preferences, in some embodiments the number of flaps 24 is four flaps 24 arranged equally spaced about the bag opening 16. In other embodiments, two flaps 24, 8 flaps 24 or other quantities of flaps 24 may be utilized.

Referring to FIG. 2, the bag 10 is manufactured to include a flap opening 28 in the flap 24. The flap opening 28 is defined by an opening edge 30 in the flap 24. In some embodiments, as shown in FIG. 2, the flap opening 28 is semi-circular. It is to be appreciated, however, that other flap opening 28 shapes are contemplated within the scope of the present disclosure, for example, circular, elliptical, rectangular or rounded-rectangular flap openings 28. In some embodiments, the opening edge 30 is a constant distance from the flap edge 26 defining a constant-width flap handle 32 or strap.

Figure 3:
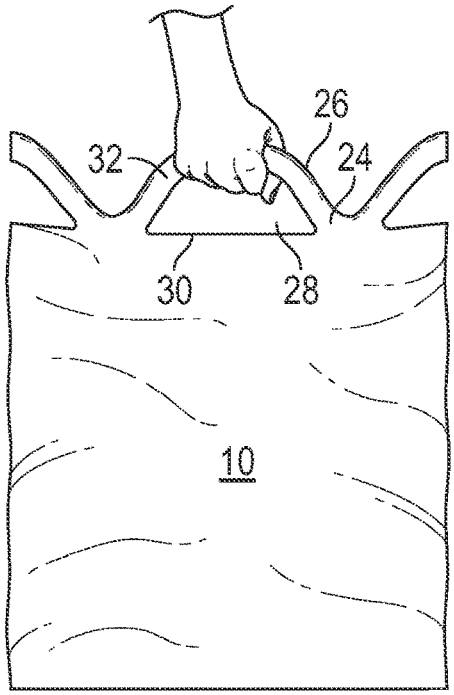
FIG. 3 is an illustration of use of a flap portion of a flap-tie bag as a handle.
Figure 4:
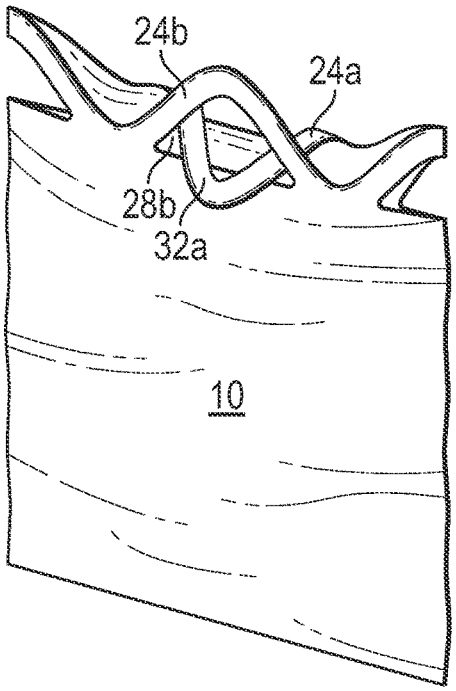
FIG. 4 is an illustration of use of a flap portion of a flap-tie bag as a closure mechanism for the bag.

Referring to FIGS. 3 and 4 the flap handles 32 formed in the flaps 24 via inclusion of the flap opening 28 can serve many purposes. First, as shown in FIG. 3, the flap handles 32 may be utilized, either singularly or as a group, to grasp and/or carry the bag 10. Additionally or alternatively, as shown in FIG. 4, the flap handles 32 may be utilized as a closure for the bag 10. This may be accomplished by, for example, inserting a first flap handle 32*a* of a first flap 24*a* through a flap opening 28*b* of a second flap 24*b*. Additional flap handles 32*c* and 32*d* of flaps 24*c* and 24*d*, respectively, may also be inserted through flap opening 28*b* to close the bag 10. Additionally, the flap handles 32 may be knotted to one another to provide additional or alternative closure of the bag 10.

Figure 5:
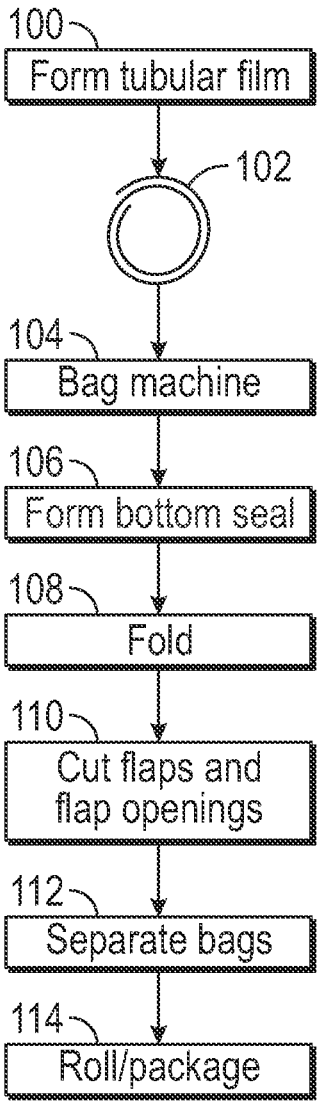
FIG. 5 is a schematic illustration of a method of making an embodiment of a flap-tie bag.

Referring now to FIG. 5, illustrated is a schematic view of a process for making an embodiment of a bag 10. The bag 10 is formed from a polyolefin material, in some embodiments the material is a polyethylene. At step 100, the material is formed into a tubular film via, for example, a blown film process. The film is transferred to a film roll at step 102, then conveyed to a bag machine at step 104. In subsequent step 106, the film is unrolled, and the bag bottom seals are formed by, for example, application of heat. At a folding station, the material is folded in step 108. At step 110, the flaps 24 and flap openings 28 are cut into the bags 10 by, in some embodiments, one or more die cutting operations. It is to be appreciated that other cutting operations may be utilized, for example, a water jet, air knife or the like. Once the selected flap 24 and flap opening shape 28 is achieved, the bags 10 are separated at step 112, and then rolled and packaged at step 114.

While the invention has been described in detail in connection with only a limited number of embodiments, it should be readily understood that the invention is not limited to such disclosed embodiments. Rather, the invention can be modified to incorporate any number of variations, alterations, substitutions or equivalent arrangements not heretofore described, but which are commensurate with the spirit and scope of the invention. Additionally, while various embodiments of the invention have been described, it is to be understood that aspects of the invention may include only some of the described embodiments. Accordingly, the invention is not to be seen as limited by the foregoing description, but is only limited by the scope of the appended claims.

The invention claimed is:

1. A unitary trash bag comprising:

a first panel and a second panel, each of the first panel and the second panel including a first panel end and a second panel end opposite the first panel end, the first panel directly connected to the second panel to define:

a bottom edge defining a closed bag end, the bottom edge defined by a direct intersection of the first panel and the second panel at their respective first panel ends;

two side edges extending from the bottom edge, each of the two side edges another intersection of the first panel and the second panel; and an open bag end disposed opposite the closed bag end defined by the respective second panel ends of the first panel and the second panel, the two side edges extending between the closed bag end and the open bag end; and four flaps disposed at the open bag end, the flaps arranged around a perimeter of the open bag end, each flap of the plurality of flaps including a flap opening in the flap to grasp and/or close the bag;

wherein a flap edge and a flap opening edge define a flap handle therebetween;

wherein the flap opening is semi-circular, the flap opening edge including a linear first portion and a nonlinear second portion;

wherein the nonlinear second portion of the flap opening edge is a constant distance from the flap edge, defining a flap handle having a constant width along its length;

wherein a first two flaps of the four flaps each span across a side edge of the two side edges; and wherein a second two flaps of the four flaps each are disposed between the two side edges and between the flaps of the first two flaps.

2. The trash bag of claim 1, wherein the four flaps are configured such that a first flap of the four flaps having a first flap opening is inserted into a second flap opening of a second flap of the four flaps to close the unitary trash bag.

3. The trash bag of claim 2, wherein the first flap and the second flap are disposed opposite each other across the open bag end.

4. The trash bag of claim 2, wherein additional flaps of the four flaps are inserted into the second flap opening.

5. The trash bag of claim 1, wherein the four flaps are defined as localized increases in a distance from the closed bag end to the open bag end.

6. The trash bag of claim 1, wherein the bag is formed from a polyethylene material.

7. A unitary trash bag comprising:

a first panel and a second panel, each of the first panel and the second panel including a first panel end and a second panel end opposite the first panel end, the first panel directly connected to the second panel to define:

a bottom edge defining a closed bag end, the bottom edge defined by a direct intersection of the first panel and the second panel at their respective first panel ends;

two side edges extending from the bottom edge, each of the two side edges another intersection of the first panel and the second panel; and an open bag end disposed opposite the closed bag end, the two side edges extending between the closed bag end and the open bag end; and four flaps disposed at the open bag end, the flaps arranged around a perimeter of the open bag end, each flap of the four flaps including a flap opening in the flap to grasp and/or close the bag; the four flaps configured such that a first flap of the four flaps having a first flap opening is inserted into a second flap opening of a second flap of the four flaps disposed opposite the first flap across the open bag end to close the unitary trash bag; the flap opening is semi-circular in shape and defines a flap handle between a flap edge and a flap opening edge, the flap opening edge including a linear first portion and a nonlinear second portion; the bag formed from a tubular film of polyethylene material;

wherein the nonlinear second portion of the flap opening edge is a constant distance from the flap edge, defining a flap handle having a constant width along its length;

wherein a first two flaps of the four flaps each span across a side edge of the two side edges; and wherein a second two flaps of the four flaps each are disposed between the two side edges and between the flaps of the first two flaps.

8. The trash bag of claim 7, wherein additional flaps of the four flaps are configured to be insertable into the second flap opening.

* * * * *